US006902476B2

(12) United States Patent
Rotter

(10) Patent No.: US 6,902,476 B2
(45) Date of Patent: Jun. 7, 2005

(54) CONTOURED VENTILATION SYSTEM FOR TILE ROOFS

(76) Inventor: Martin J. Rotter, 115 Lismore Ave., Glenside, PA (US) 19038

( * ) Notice: Subject to any disclaimer, the term of this patent is extended or adjusted under 35 U.S.C. 154(b) by 0 days.

(21) Appl. No.: 10/914,455

(22) Filed: Aug. 9, 2004

(65) Prior Publication Data

US 2005/0048912 A1 Mar. 3, 2005

Related U.S. Application Data

(63) Continuation of application No. 10/677,831, filed on Oct. 2, 2003, now Pat. No. 6,773,342.

(60) Provisional application No. 60/415,475, filed on Oct. 2, 2002.

(51) Int. Cl.[7] ..... F24F 7/02
(52) U.S. Cl. ..... 454/365; 52/199
(58) Field of Search ..... 454/364, 365, 454/366; 52/199

(56) References Cited

U.S. PATENT DOCUMENTS

| | | | | |
|---|---|---|---|---|
| 1,717,728 A | | 6/1929 | Moore | |
| 4,876,950 A | * | 10/1989 | Rudeen | 454/365 |
| 4,924,761 A | * | 5/1990 | MacLeod et al. | 454/365 |
| 5,427,571 A | * | 6/1995 | Sells | 454/365 |
| 5,676,597 A | | 10/1997 | Bettoli et al. | |
| 6,115,343 A | | 9/2000 | Narumi et al. | |
| 6,267,668 B1 | * | 7/2001 | Morris | 454/365 |
| 6,286,273 B1 | | 9/2001 | Villela et al. | |
| 6,595,849 B2 | * | 7/2003 | Miller | 454/365 |
| 6,773,342 B2 | * | 8/2004 | Rotter | 454/365 |

* cited by examiner

*Primary Examiner*—Harold Joyce
(74) *Attorney, Agent, or Firm*—Volpe and Koenig, P.C.

(57) ABSTRACT

A profiled ridge vent for tile roofs is provided having a vent strip located on each side of a roof ridge. Each vent strip includes a vent material, formed from a non-woven mat, including a first surface, contoured to a profile to match a profile of the tile roof, and a second surface. An upper water barrier is attached to the second surface of at least one of the vent strips and extends over the roof ridge. A water dam is attached to the first surface and extends in an up-slope direction toward the roof ridge. In use, a first vent strip is located on a first side of a roof ridge pole, and a second vent strip is located on a second side of the roof ridge pole. The upper water barriers of the first and second vent strips overlap one another at the ridge pole. Preferably, adhesive is provided on at least one of the upper water barriers so that the two water barriers are connected together. Alternatively, a single water barrier is provided which bridges the ridge pole and joins the first and second vent strips. Cap shingles which conceal the water barriers are connected to the ridge pole. Ends of the cap shingles rest on portions of the first and second vent strips.

15 Claims, 3 Drawing Sheets

CONTOURED VENTILATION SYSTEM FOR TILE ROOFS

CROSS REFERENCE TO RELATED APPLICATION

This application is a continuation of U.S. patent application Ser. No. 10/677,831, filed Oct. 2, 2003, now U.S. Pat. No. 6,773,342 which claims the benefit of U.S. Provisional Patent Application No. 60/415,475, filed Oct. 2, 2002, which is incorporated by reference herein as if fully set forth.

BACKGROUND

This invention is related to the general field of attic and roof ventilation systems. It is particularly related to a roof ridge ventilating system for tile roofs.

It has been a long known practice to ventilate attics under gable roofs by running a vent along the roof ridge. Such vents are created by an open slot running along the roof ridge, essentially the length of the roof, which causes ventilation out of the attic by convection airflow and by suction from wind blowing across the roof.

Differences between the various types of ridge vents are often found in the capping structures used over the vent slot to exclude water and pests. A description of representative types of ridge vents and capping structures, and attributes or problems associated with various types, is found in a prior patent of this inventor, U.S. Pat. No. 5,167,579. That patent discloses, as a solution to many of the problems associated with prior ridge vents, an improved roof ridge venting system using a unitary mat constructed of randomly-aligned synthetic fibers which are joined by phenolic or latex binding agents and heat cured to provide an air-permeable mat with a varying mesh. Cap shingles are supported by the mat and are nailed directly to the roof through the mat. In contrast to other vent materials, the unique features of the mat disclosed in this prior patent result in many desirable physical properties such as high tensile strength, high resiliency, the ability to be transported in rolls and cut to length, ease of joining strips, durability in local ambient conditions, and the ability to act as a water and an insect barrier. Moreover, it provides the aforementioned desirable features in a thin sheet to permit the vent structure to maintain a low profile along the roof ridge.

Although the vent disclosed in the inventor's prior patent has desirable applications in many generally flat roof types, it can not be used in conjunction with contoured roofs or with heavy roofing tiles. As used herein, the phrase "heavy roofing tiles" refers to tiles made from materials which include, but are not limited to, slate, terra cotta, concrete, and clay. These tiles are distinguished by their bulk and weight, as contrasted to the relatively lighter shingles made of asphalt, wood, fiberglass, polymers and the like.

The prior known vent structures useable with such heavy roofing tiles generally included structure to support the capping elements, which are frequently heavy ridge cap tiles of same or similar shape and construction as the roof tiles, for example, as provided in the inventor's prior U.S. Pat. No. 5,326,318. However, the construction of an assembled support from bent-up sheet metal and porous vent material requires shipment in fixed lengths. The cost for making and shipping this type of vent would therefore be high. Additionally, if the roof tiles and cap tiles were "mudded" into position with cement to close the gaps between the overlapping cap tiles, as well as the gaps between the bottom of the cap tiles and the valleys of the roof field tiles along the roof ridge, these gaps, which were intended to remain open for venting in such prior known systems, would likely be filled with cement in accordance with customary roofing practices to prevent leaks, and therefore block any air flow that the vent was intended to provide.

A contoured roof ridge ventilation system for metal roofs has also been developed by the present inventor, and is described in U.S. Pat. No. 5,561,953. This system is intended for use with metal roof panels having a contoured surface, and provides a contoured ventilation strip covered with a flat cap that is nailed to the roof structure. This does not address tile roofs, in which not only the field of the roof is contoured, but also the cap is cylindrical shaped and tiled, such that the bottoms of the cap tiles do not present an even surface, and in which rain driven parallel to the roof ridge may penetrate between the cap tiles.

SUMMARY

The present invention is directed to a novel roof ridge ventilation system which is designed for use with heavy ridge tiles, and to a method of venting such tiled roofs with this novel system. In particular, it is designed for typical tile roofs, wherein the tiles have a generally semi-circular section profile, and are laid in rows alternatingly inverted and overlapped with the preceding row to form an undulating sequence of crests and gutters. The same or similar shaped tiles are then laid along the ridge and affixed to the ridge pole to cap over the vent slot and to impart a rounded appearance to the ridge.

The present invention provides a profiled ridge vent for tile roofs. The vent comprises a vent strip located on each side of the ridge. Each vent strip includes a vent material, preferably formed from a non-woven mat that includes a first surface, contoured to a profile to match a profile of the tile roof, and a second surface. An upper water barrier is attached to the second surface and extends over the roof ridge. A water dam is preferably attached to the first surface and extends in an up-slope direction. The water dam includes a bent-up portion that extends toward the second surface. The water dam follows the contoured profile of the first surface.

In use, a first vent strip is located on a first side of a roof ridge pole, and a second vent strip is located on the second side of the roof ridge pole. Since the vent strips are independent of one another, no specific alignment of the roof tiles on either side of the ridge is required, and the vent strips can be adjusted to accommodate any width of the ridge cap tiles. The upper water barriers of the first and second vent strips overlap one another at the ridge pole. Preferably, adhesive is provided on at least one of the upper water barriers so that the two water barriers are connected together. Alternatively, a single water barrier is provided which extends from the first vent strip and bridges the ridge pole and contacts the top of the second vent strip. The upper water barriers direct any moisture that passes through the cap tiles away from the vent slots through the roof structure.

The lower water dam is preferably J-shaped, and is flexible so that lengths of the tile roof vent strips can be rolled for shipping. The lower water dam prevents moisture ingress through the vent strips, and redirects any moisture that may ultimately penetrate through the vent material back down the roof.

BRIEF DESCRIPTION OF THE DRAWINGS

The present invention will be explained in more detail in connection with the drawings in which presently preferred embodiments are shown.

In the drawings.

DETAILED DESCRIPTION OF THE PREFERRED EMBODIMENTS

Figure 1:
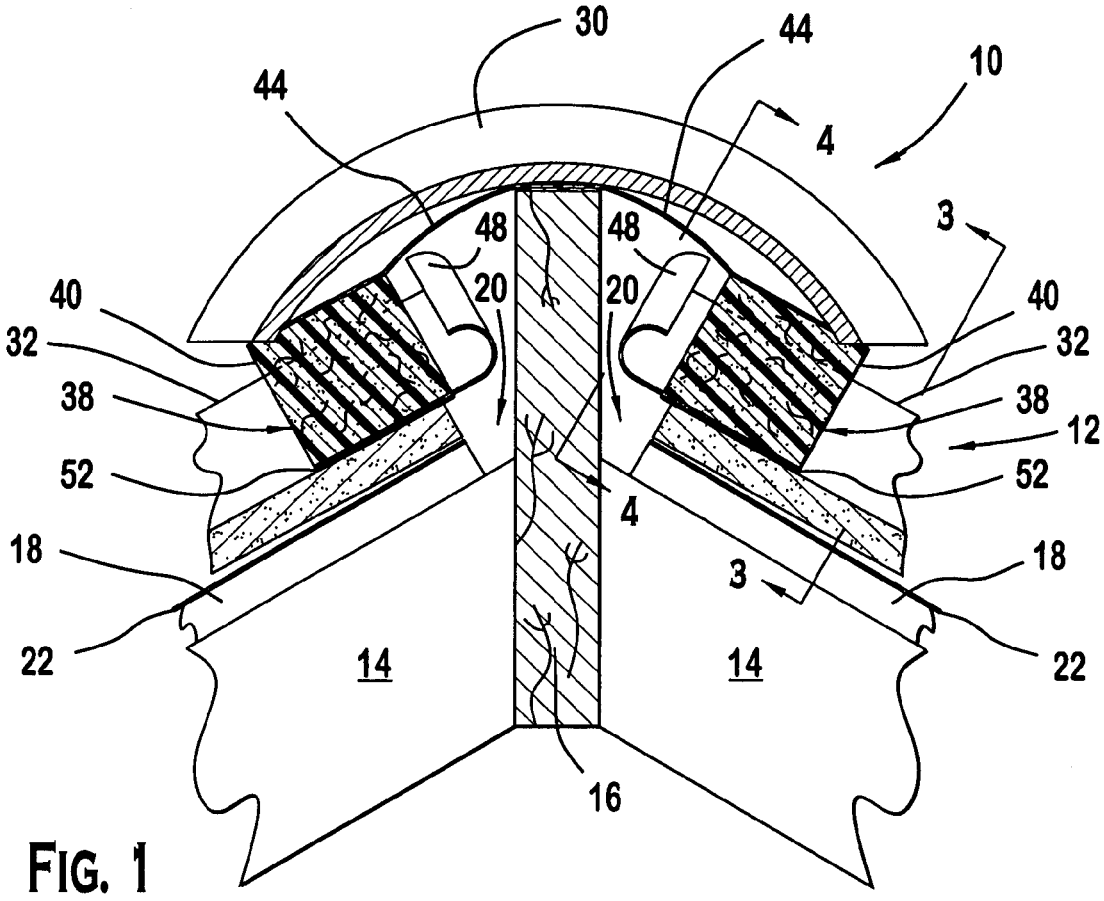
FIG. 1 is a cross-sectional view through a roof ridge showing the contoured ventilation system for tile roofs in accordance with a first preferred embodiment of the present invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The preferred embodiments of the present invention will be described with reference to the drawing figures where like numerals represent like elements throughout.

Referring now to FIG. 1, a contoured ventilation system 10 for a tile roof 12 is shown. The tile roof 12 includes a roof structure formed from roof rafters 14 that are connected to a ridge pole or beam 16. Sheathing 18 may be applied over the rafters 14, as shown, and a gap or slot 20 is left on each side of the ridge pole 16 for the ridge vent. Alternatively, purlins or other support structures can be utilized. The ridge pole 16 extends above the sheathing 18, or is built up to a desired height, so that the cap shingles 30 for the tile roof 12 can be affixed to it. Roofing felt or another water barrier 22 is applied over the sheathing 18. The roof tiles 32 are then placed in position on the roof until the final, uppermost row of tiles 32 ends at a point below the slots 20.

Figure 2:
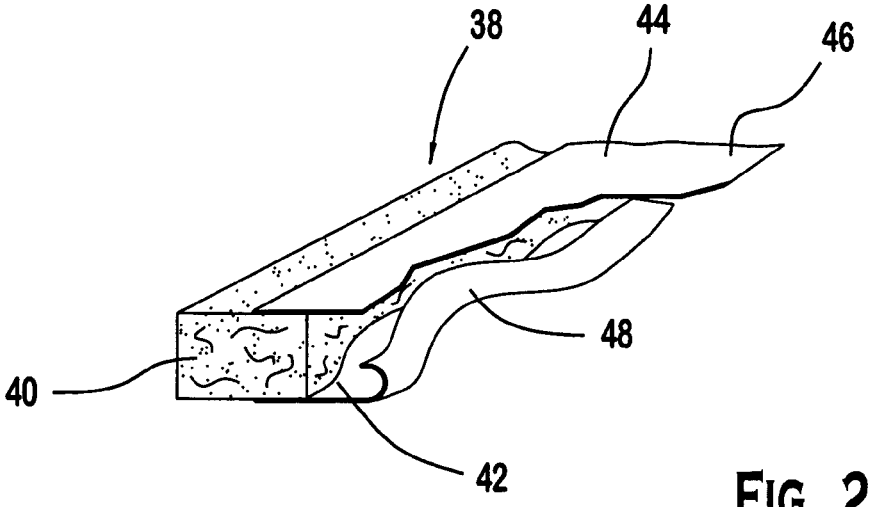
FIG. 2 is a perspective view, partially broken away, of the vent strip used in the contoured ventilation system for tile roofs shown in FIG. 1.

As shown in FIGS. 1 and 2, the ventilation system 10 is comprised of vent strips 38 formed from a contoured strip of vent material 40. The vent material 40 is preferably a non-woven synthetic material that has a high net open free area to allow for air passage therethrough, while acting as a filter to prevent ingress by bugs or debris. The material also prevents moisture permeation, such as wind driven rain, while still allowing air flow for attic ventilation. A preferred material is disclosed in the inventors prior U.S. Pat. No. 5,167,579. However, other suitable mesh materials, whether woven or non-woven may be utilized. The vent material 40 has a first surface 42 which is contoured with a complementary profile to the roof tiles 32, and a second surface, generally opposite to the first surface that is generally flat. The vent material 40 preferably has a thickness that is greater than a depth of the valleys in the roof tiles 32 so that it can be contoured and remain in one piece. The material 40 may be formed as a single piece, or may be made of a plurality of pieces of material that are connected together, such as by adhesives, sewing, heat staking, heat or friction welding or fusion, or any other suitable means. The layers may be made of the same or different materials, with at least one layer of material being air permeable. The vent material 40 is preferably adhered to the roof tiles 32 by an adhesive 52 applied to at least one of the vent material 40 and the roof tiles 32.

An upper water barrier 44 is affixed to the second surface of the vent material 40. The upper water barrier 44 is wide enough so that it will extend over the ridge pole 16 in the installed position, and at least partially overlaps the second surface of the vent material 40. The upper water barrier is preferably made of a closed cell foam material or a polyvinyl chloride or other polymeric sheet material, but may be made from any suitable water resistant material that can be adhered to or affixed to the vent material 40, such as by an adhesive, heat staking, sewing, solvent or heat welding, or by any other suitable means. An adhesive material 46 may be applied to one or both sides of the free ends of the upper water barriers 44, so that upon installation, the upper water barriers 44 from the vent strips 38 overlap and can be adhered to one another. However, this is not required. As shown in FIG. 1, preferably the upper water barrier 44 has some stiffness and is bowed outwardly, toward the underside of the ridge cap tiles 30.

A water dam 48 is preferably attached to the vent strip 38. The water dam 48 is preferably J-shaped, but could also be generally L-shaped. Preferably, one leg of the water dam is attached to the first, contoured surface 42 of the vent material 40 by an adhesive, sewing, heat staking, heat or solvent welding, or through any other suitable attachment means. The water dam 48 is preferably formed from a water resistant polymeric material that has sufficient rigidity that the J shape will be maintained, while also allowing the vent strip 38 to be rolled for shipping.

Figure 5:
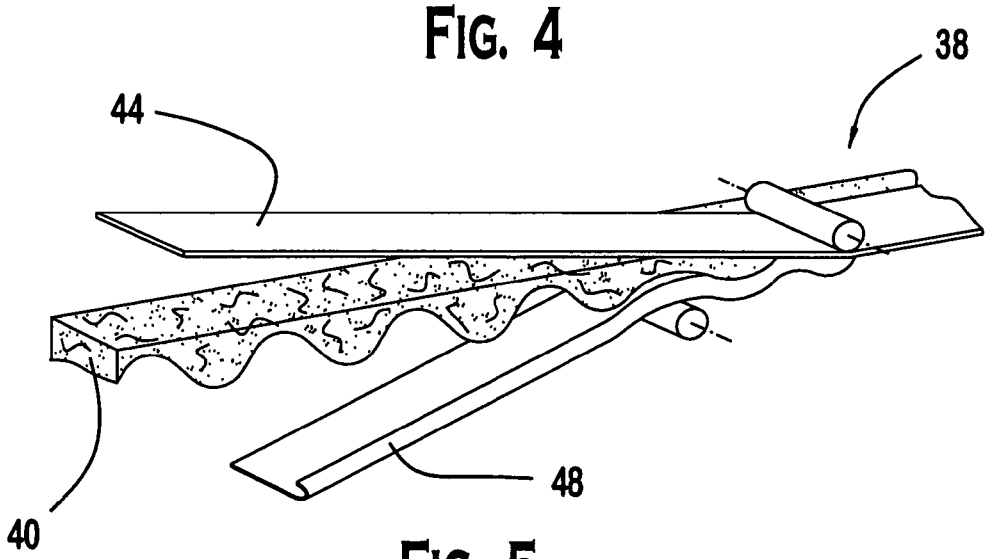
FIG. 5 is a perspective view showing the contoured vent strip being assembled from the contoured vent material, the upper water barrier and the water dam.

Preferably, as shown in FIG. 5, the vent strip 38 is assembled in a continuous process, with the upper water barrier 44 being adhered to the upper surface of the contoured vent material 40, and the water dam 48 being adhered in a continuous strip to the contoured, lower surface 42 of the vent material 40.

Figure 6:
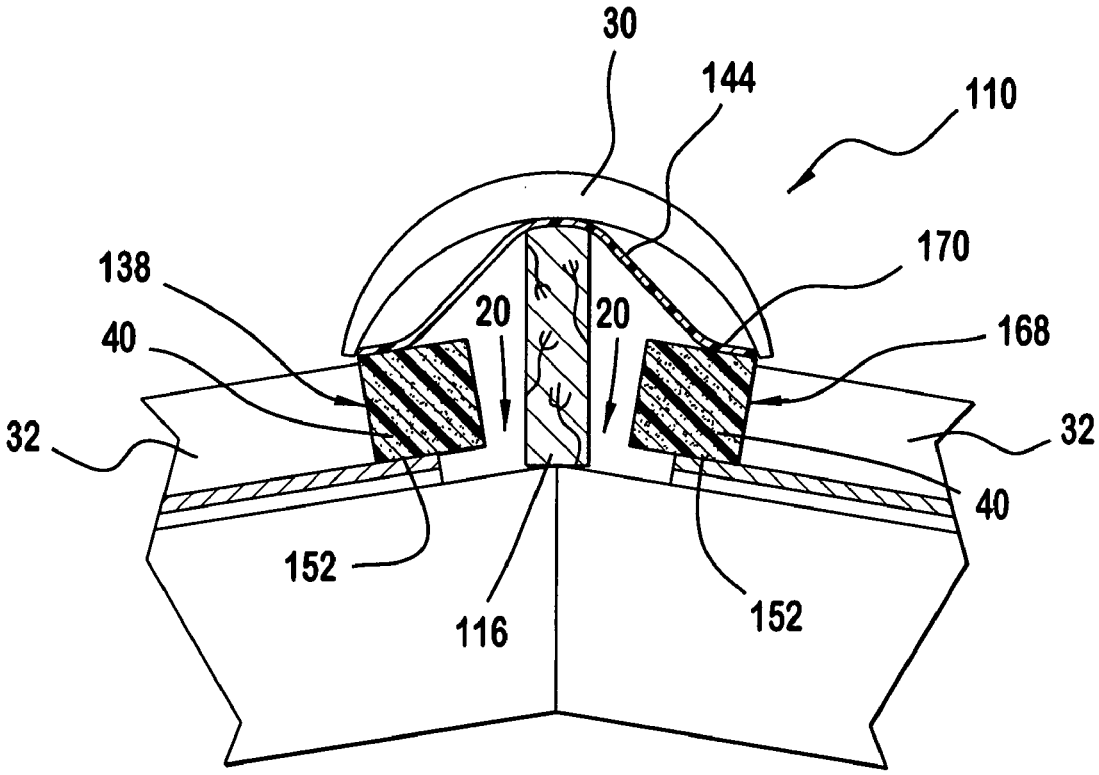
FIG. 6 is a cross-sectional view through a roof ridge showing the contoured ventilation system for tile roofs in accordance with a second preferred embodiment of the present invention.

Making reference to FIG. 6, a ventilation system 110 according to a second preferred embodiment of the present invention is shown. In this embodiment, a single water barrier 144 is attached to a first vent strip 138. The water barrier 144 may be attached to the first vent strip 138 by the procedures described above with reference to the upper water barriers 44 of the first preferred embodiment. A second vent strip 168 is provided without a water barrier to be positioned adjacent to the first vent strip 138 on the opposite side of the ridge pole 116. Adhesive 152 is provided to secure vent strips 138, 168 to the roof tiles in a similar manner to that shown in FIG. 1 with reference to the first preferred embodiment. Additionally, adhesive 170 is provided for attaching a free end of the water barrier 144 to the second vent strip 168 during installation.

Figure 3:
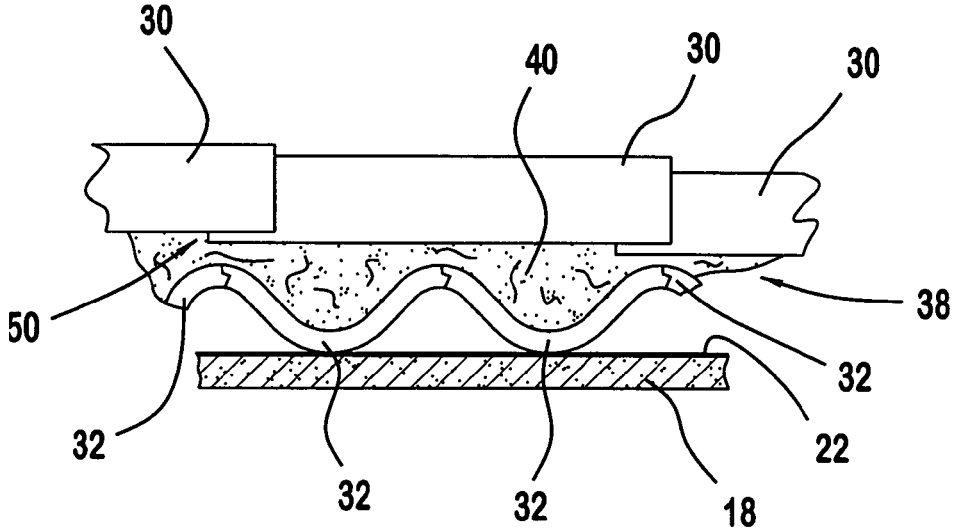
FIG. 3 is a view taken along line 3—3 in FIG. 1.
Figure 4:
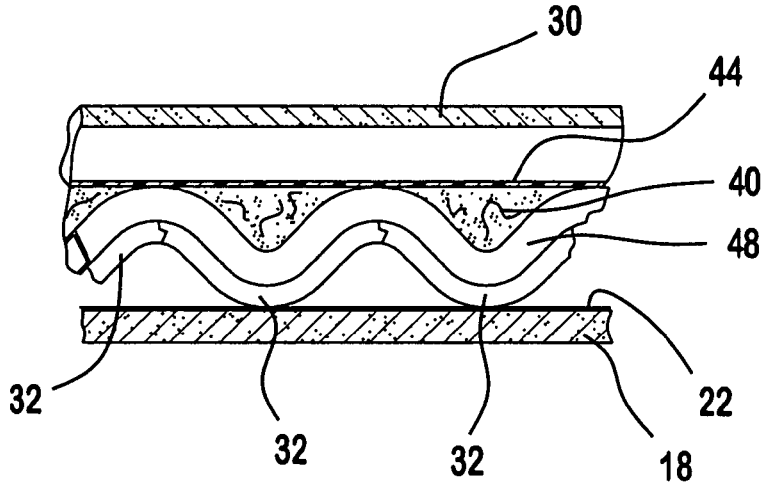
FIG. 4 is a view taken along line 4—4 in FIG. 1.

Referring to FIGS. 1, 3 and 4, for installation of the first preferred embodiment, the vent strips 38 are located on the roof tiles 32 at each side of the roof ridge. The contoured surface 42 of each strip 38 is aligned with the complementary projections and recesses of the roof tiles 32, with the upper water barriers 44 overlapping one another over the ridge pole 16. The adhesive 52 attaches the vent strips 38 to the roof tiles 32. The adhesive 52 may include a fluid or semi-solid substance applied to at least one of the vent strips 38 and the roof tiles 32 during the installation process. Alternatively, the adhesive 52 may include adhesive strips, of the type known in the art, supplied pre-attached along the contoured surface 42 of each vent strip 38. These adhesive strips preferably include a release strip which, when removed, reveals an adhesive such as acrylic or silicone.

Since the two vent strips 38 are not connected together, no specific alignment of the roof tiles 32 on either side of the ridge is required. Additionally, the spacing of the vent strips 38 from the ridge pole 16 can be adjusted to any width of cap tile 30 since the upper water barriers 44 can adjustably overlap one another. If an adhesive is provided on one or both free ends 46 of the upper water barriers 44 of the vent strips 38, the upper water barriers 44 are adhered together. The cap tiles 30 are then installed and preferably connected to the ridge pole 16 with fasteners (not shown).

Referring now to FIG. 6 showing the second preferred embodiment, the first and second vent strips 138, 168 are secured to roof tiles 32, using adhesive 152, in a manner identical to that described above with reference to the vent strips 38 of the first preferred embodiment. After the vent strips 138, 168 are correctly positioned, the water barrier 144, provided on the first vent strip 138, is attached to the second vent strip 168 by an adhesive 170 at installation. The adhesive 170 may include either a liquid or semi-solid adhesive, or alternatively adhesive strips of the type described above, applied to at least one of the second vent strip 168 and the water barrier 144. Adhesive strips are preferably permanently attached to the water barrier 144 and include a release strip which is removed immediately prior to securing the water barrier 144 to the second vent strip 168. The ridge cap tiles 130 are placed over the secured water barrier and rest on the vent strips 138, 168. The ridge cap tiles 130 are preferably installed flush with the water barrier 144 which preferably rests on the ridge pole 116 as shown, but alternatively, two or more of the tiles 30, water barrier 144, and the ridge pole 116 may be installed spaced apart from each other. The ridge cap tiles 130 are also preferably connected to the ridge pole 116 with fasteners (not shown).

As shown in FIGS. 1 and 3 of the first preferred embodiment, the vent material 40 is partially compressed by the cap tiles 30 so that the gaps (indicated at 50) created by overlapping cap tiles 30 are filled. Additionally, in a preferred embodiment where the vent material is at least partially formed of a non-woven synthetic fiber matting as described, for example in U.S. Pat. No. 5,167,579, the vent material 40 is preferably heated so that it "lofts" or expands and is then calendered down to a specific thickness prior to the profiles being cut to match the roof contours. Since the material 40 is calendered, it can also expand somewhat due to sun generated heat on the roof after installation in order to further fill the gaps 50 to prevent the ingress of insects or debris. The cap tiles 131 of the second preferred embodiment, shown in FIG. 6, do not compress the vent material 40. However, alternatively, the cap tiles 131 may be configured to rest on and at least partially compress the vent material as provided in the first preferred embodiment.

In use, the upper water barriers 44, 144 prevent any moisture which may permeate the seams between the overlapping ridge cap tiles 30, 130 from penetrating the roof structure through the slots 20. Any wind driven moisture that is driven up the roof slope is stopped by the vent material 40, and if there is any possible permeation of the vent material 40, the water dam 48 blocks further ingress of the moisture and redirects the moisture back down the roof. Depending on the thickness (in a direction parallel to the roof surface) and porosity of the vent material 40, it is possible that the water dam 48 can be entirely omitted as shown in the second preferred embodiment of FIG. 6.

In one preferred embodiment, the vent material has a maximum height of about 3 inches and a minimum height of about 0.5 inch between the first and second surfaces. The upper water barrier 44 or 144 extends approximately 6 inches from an upper edge of the vent material 40. The water dam 48 has a height of between 0.5 and 1.0 inches. However, different sizes can be used depending on the particular tile roof profile.

While the preferred embodiments of the invention have been described in detail, the invention is not limited to these specific embodiments described above which should be considered as merely exemplary. Further modifications and extensions of the present invention may be developed and all such modifications are deemed to be within the scope of the present invention as defined by the appended claims.

What is claimed is:

1. A ventilated tile roof, comprising:

a support structure;

a vent opening through the support structure located along a ridge of the roof;

a plurality of roof tiles located on the support structure defining a plurality of crests and gutters;

a first vent strip located on a first side of the vent opening along the ridge, and having a first surface complementary to the crests and gutters of the roof tiles in an installed position, and a second surface;

a second strip located generally parallel to the first vent strip on an opposite side of the roof ridge and having a first surface complementary to the crests and gutters of the roof tiles in an installed position, and a second surface;

at least one upper water barrier positioned above the second surfaces of the first and second vent strips and extending toward the ridge; and cap tiles having a lower surface that contacts the second surfaces of the first and second strips or the water barrier located on the first and second strips.

2. The ventilated tile roof according to claim 1, wherein the at least one water barrier includes first and second water barriers attached to the first and second vent strips, respectively, each of the water barriers extending from a respective vent strip toward the other water barrier.

3. The ventilated tile roof according to claim 2, wherein a free end of at least one of the water barriers rests on a ridge pole forming the roof ridge located between the first and second vent strips.

4. The ventilated tile roof according to claim 3, wherein the first and second water barriers each include free ends which overlap each other.

5. The ventilated tile roof according to claim 4, wherein the free ends of the first and second water barriers are adhered to each other.

6. The ventilated tile roof according to claim 1, wherein the at least one water barrier comprises a single water barrier having a first end that is attached to the first vent strip, and a second end that is in contact with the second vent strip.

7. The ventilated tile roof according to claim 1, wherein the at least one water barrier comprises a single water barrier, and a first end of the single water barrier is attached to the first vent material, and a second end of the water barrier is connected by an adhesive to the second vent material.

8. The ventilated tile roof according to claim 7, wherein the water barrier is bonded by a strip of adhesive, having a removable covering, to the second vent material.

9. The ventilated tile roof according to claim 1, wherein the first and second vent strips are comprised of a porous material.

10. The ventilated tile roof according to claim 9, wherein the porous material is a synthetic fiber mesh.

11. The ventilated tile roof according to claim 1, wherein the first and second vent materials include contouring on the respective first surfaces for mating with complementing contouring of the crests and gutters of the roof tiles.

12. The ventilated tile roof according to claim 1, wherein at least one of the first and second vent materials and the roof tiles includes adhesive applied thereon for securing the first and second vent strips to the roof tiles.

13. The ventilated tile roof according to claim 12, wherein the adhesive is a pressure sensitive strip of adhesive having a removable backing which exposes a pressure sensitive adhesive.

14. The ventilated tile roof according to claim 1, wherein at least one of the first and second vent strips includes a water dam, connected thereto at a first end of the water dam, which extends along a length of the respective vent strip, for preventing ingress of water.

15. The ventilated tile roof according to claim 14, wherein the water dam includes a second end having a curved portion to assist in preventing ingress of water.

* * * * *

UNITED STATES PATENT AND TRADEMARK OFFICE

CERTIFICATE OF CORRECTION

PATENT NO. : 6,902,476 B2
DATED : June 7, 2005
INVENTOR(S) : Martin J. Rotter

It is certified that error appears in the above-identified patent and that said Letters Patent is hereby corrected as shown below:

Title page,
Item [56], References Cited, U.S. PATENT DOCUMENTS, delete
"6,115,343 A 9/2000 Narumi et al." and insert therefor
-- 6,015,343 1/2000 Castillo et al. --.

Signed and Sealed this

First Day of November, 2005

JON W. DUDAS
*Director of the United States Patent and Trademark Office*